United States Patent [19]

Clark

[11] Patent Number: 4,979,922

[45] Date of Patent: Dec. 25, 1990

[54] FLYING SAUCER CAPABLE OF SKIPPING ON FLUIDS

[76] Inventor: Thomas L. Clark, 826 Avenue D, Traverse City, Mich. 49684

[21] Appl. No.: 165,176

[22] Filed: Mar. 3, 1988

[51] Int. Cl.[5] ..... A63H 27/00; A63B 63/10

[52] U.S. Cl. ..... 446/46; 273/424

[58] Field of Search ..... 446/46, 47, 48; 273/424, 425

[56] References Cited

U.S. PATENT DOCUMENTS

| | | | |
|---|---|---|---|
| 3,185,480 | 5/1965 | Weyman et al. | 446/46 |
| 3,900,987 | 8/1975 | Holt | 273/424 |
| 4,176,843 | 12/1979 | DeWitt, Jr. | 446/46 |
| 4,205,484 | 6/1980 | Kovac | 446/46 |
| 4,255,893 | 3/1981 | Anderson et al. | 446/48 |
| 4,288,942 | 9/1981 | Nicholl | 273/424 |
| 4,334,438 | 6/1982 | Melin et al. | 446/46 |
| 4,351,129 | 9/1982 | Kenbenbush et al. | 446/46 |
| 4,553,758 | 11/1985 | Zahr | 273/424 |

*Primary Examiner*—Robert A. Hafer
*Assistant Examiner*—Michael Brown
*Attorney, Agent, or Firm*—Michael L. Bauchan

[57] ABSTRACT

A flying saucer capable of skipping on fluids is provided. The flying saucer includes a conventional flying saucer disk having a substantially circular dome-shaped body and downwardly extending rim at the periphery of the body. A substantially circular insert is positioned inside the rim proximate the interior surface of the dome-shaped body. The insert has a lower surface substantially flush with the lowest edge of said rim and the lower surface of the insert is provided with at least one recess which may be grasped to facilitate throwing the saucer. When the insert strikes a fluid surface such as water or snow as the saucer lands, the saucer skips on the fluid surface.

21 Claims, 5 Drawing Sheets

FLYING SAUCER CAPABLE OF SKIPPING ON FLUIDS

BACKGROUND OF THE INVENTION

Flying saucer toys have been in common usage for many years. Such toys in general comprise a circular disk having a dome-shaped body with a downwardly extending rim. A major manufacturer of such toys is Wham-O manufacturing company of San Gabriel, Calif. which sells such toys under various United States Trademarks, including "Wham-O" and "Frisbee" and holds various patents including U.S. Pat. No. 3,359,678.

Flying saucer toys generally have a relatively thich downwardly extending rim and a relatively thin section above the rim so as to have the greatest moment of inertia by placing a relatively large percentage of the weight in the outer rim and using a relatively thin, flexible membrane across the rim to trap air underneath the disk as it flies through the air.

Various modifications of the basic flying saucer disk design have been made, including such as are disclosed in U.S. Pat. Nos. 4,117,626; 4,255,893; 4,143,483; and 4,196,540.

Some flying saucers have been made of an inflatable type such as that disclosed in U.S. Pat. No. 2,864,201 and French Pat. No. 1,603,662.

Such flying saucers are generally designed for flying through the air. To maximize air flight they have a generally dome-shaped body in most instances to trap a cushion of air under the saucer, but when such saucers strike a fluid surface such as on water or snow the saucer edge enters the fluid, bringing the flight to an abrupt end. The above U.S. Pat. No. 2,864,201 to Leise describes an inflatable discus intended for water sports, but it is designed as a very heavy flying saucer which is described to weigh approximately 2 pounds in a 12 inch diameter size and 4 pounds 6.4 ounces in a 24 inch diameter size in order to substantially duplicate a standard discus used since ancient times in sporting events. The heavy discus designed by Leise does not lend itself to either good flight characteristics because of it not having the ability to trap a cushion of air nor does it lend itself to good skipping characteristics on water due to its large size and weight.

It is therefore a primary object of this invention to provide a lightweight flying saucer toy which is so constructed as to provide good flight characteristics in the air as well as the ability to skip on a fluid surface, particularly water and snow.

It is a further object of this invention to provide a flying saucer which is capable of good flight characteristics and skipping on a fluid surface such as water and snow and which provides a convenient design for grasping and throwing the saucer.

It is a further object of this invention to provide a flying saucer insert which may be distributed separately from flying saucers and which may be readily combined with conventional flying saucers such as those manufactured by Wham-O manufacturing company of San Gabriel, Calif. so as to adapt those conventional flying saucers into saucers which retain good flight characteristics but which also have the ability to be skipped on a fluid surface such as water or snow.

SUMMARY OF THE INVENTION

A flying saucer is provided which is capable of skipping on the surface of a fluid, such as when thrown on water or snow. The flying saucer includes a disk having a substantially circular dome-shaped body and a downwardly extending rim substantially at the periphery of the body. An insert is provided made of a lightweight substantially rigid material which fits inside the dome-shaped body. The insert has a lower surface substantially flush with the lowest edge on the rim and is provided with at least one recess to facilitate grasping the disk and insert to throw the saucer.

In a first embodiment the insert has substantially flat and parallel top and bottom surfaces and is inserted just inside the rim of the disk.

In a second embodiment the disk is tapered for at least part of its upper surface.

In a third embodiment the bottom surface of the insert is tapered radially outward.

In a fourth embodiment the bottom surface of the insert is tapered radially outward and the insert has a contour edge to form a smooth junction with the disk ridge.

In a fifth embodiment the insert has a convex bottom surface to facilitate skipping on a fluid.

In a sixth embodiment the insert is formed in place to completely fill the interior of the disk.

In a seventh embodiment the insert has at least part of its surface covered with an adhesive for attaching the insert inside the disk.

DESCRIPTION OF THE PREFERRED EMBODIMENT

Figure 1:
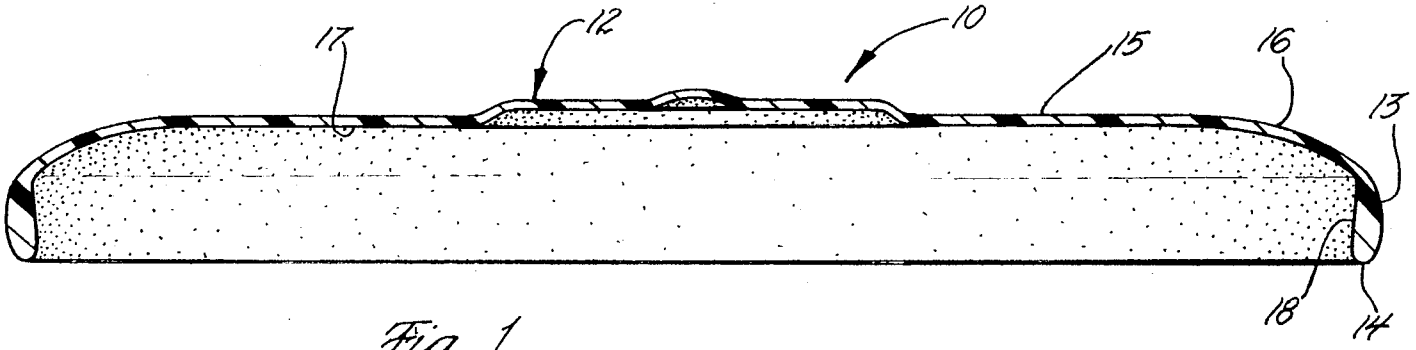
FIG. 1 is a cross-section view of a conventional flying saucer disk.

As shown in FIG. 1, a conventional flying saucer 10 is illustrated which includes a disk 12 having a circular dome-shaped body having a downwardly extending rim 13 at the periphery of the disk 12. The rim 13 extends downward and has a rounded edge 14 and a top 15. The disk 12 in the usual type of construction such as those disks manufactured by Wham-O Manufacturing Company of San Gabriel, Calif. is made so the rim 13 is substantially thicker than the top 15. The disk 12 has an exterior surface 16 extending over the exterior of the disk 12 and an interior surface 17 under the top 15, the interior surface 17 and the exterior surface 16 being separated by edge 14, which is a circle at the bottom of rim 13.

Persons versed in the art will appreciate that disk 12 can be manufactured of numerous types of material. To maximize flight characteristics as the disk 12 is thrown, such as by a backward movement of the hand, the disk 12 is sent spinning substantially horizontally except when curved flight is desired. The interior surface 17 of disk 12 traps a cushion of air under top 15. Maximum flight stability is further assured by making rim 13 substantially thicker than the thickness of top 15, putting a large weight percentage of disk 12 in rim 13 so as to increase the moment of inertia of the spinning disk 12.

As shown in FIG. 1, flight characteristics are improved by the inside surface 18 of rim 13, which is a part of the interior surface 17, tapering inwardly and downwardly, which tends to retain trapped air under top 15 even when the disk 12 is thrown at an angle to the horizontal direction for curves and other trick flight movement.

Disk 12 is usually made of a plastic which results in a semi-rigid rim 13 and a flexible top 15, depending on thickness of the top 15. While usually made of plastic, disk 12 can also be made of rubber, aluminum, and various other materials with which persons versed in the art are familiar and which are commercially available.

Figure 2:
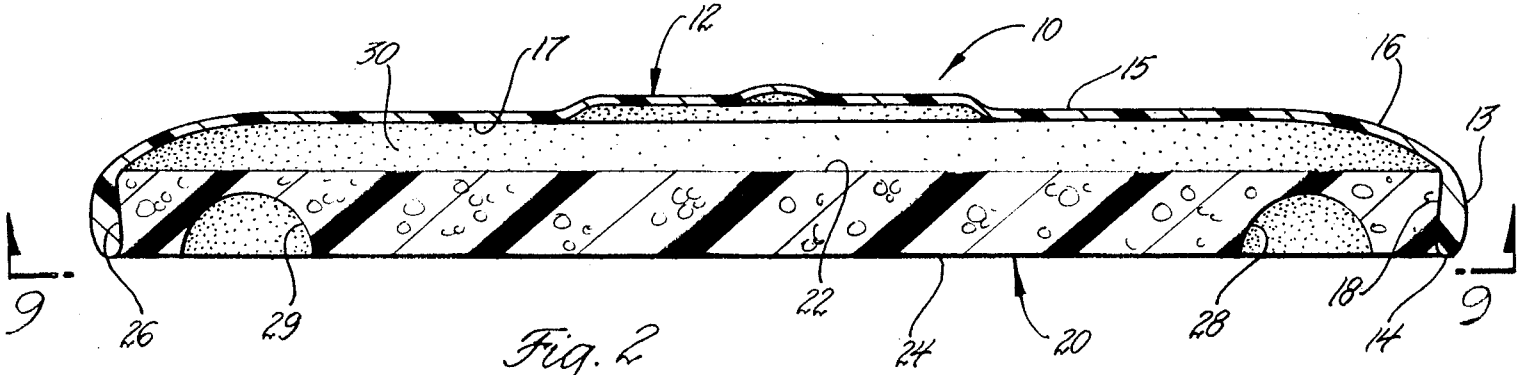
FIG. 2 is a cross-section view of a flying saucer embodying the principals of the subject invention and containing an insert having flat and substantially parallel top and bottom surfaces.

As shown in FIG. 2, a flying saucer 10 is illustrated which embodies the principals of the subject invention by combining disk 12 as shown and described in connection with FIG. 1 with an insert 20. Insert 20 in the preferred embodiment is circular and essentially may be described as a short truncated cone in it's basic design, but this basic configuration may be modified for various purposes as will be described in the various embodiments set forth herein. Insert 20, as persons versed in the art will appreciate, may be of various materials. It is preferably of a uniform density lightweight, rigid foam. An appropriate material for insert 20 would be styrofoam but it may also be made of plastic or other materials which exhibit the desired characteristics.

Insert 20 in the preferred embodiment is removable from disk 12 and includes an upper surface 22 proximate the interior surface 17 of disk 12, a lower surface 24 opposite the upper surface 22, and outer surface 26 adjacent the interior side 18 of rim 13, and two recesses 28–29 in lower surface 24 near the outer surface 26 used as finger holds to facilitate a user of the flying saucer 10 grasping the disk 12 and insert 20 to throw flying saucer 10 in a conventional manner.

In the embodiment illustrated in the various drawings disk 12 is provided with interior side 18 of rim 13 tapering inwardly and downwardly. This facilitates both the trapping of an air cushion under interior surface 17 when disk 12 is thrown without an insert 20 and also facilitates grasping the rim 13 of disk 12 for purposes of throwing it in a conventional manner, which typically is by a user throwing it with a back-handed movement and flick of the wrist. Insert 20 as shown in FIG. 2 takes advantage of this inwardly and downwardly taper of the interior side 18 of rim 13 so that outer surface 26 of insert 20 approximates the same inward and downward taper as interior side 18 of rim 13. Since disk 12 is customarily made of plastic or other slightly flexible material, insert 20 may be forced into disk 12 with a press fit and the inwardly and downwardly taper of outer surface 26 securely retains insert 20 inside disk 12 adjacent interior side 18 of rim 13.

In the embodiment illustrated in FIG. 2 insert 20 has upper surface 22 and lower surface 24 parallel and spaced a distance which is the approximate height of interior side 18 of rim 13 so that when insert 20 strikes a fluid surface such as water the insert 20 is not forced farther inside disk 12 and lower surface 24 remains at substantially the same elevation as the bottom edge 14 of rim 13. Thus when flying saucer 10 strikes a fluid surface a substantially uniform surface comprising the rim 13, edge 14, and lower surface 24 strikes the fluid, causing flying saucer 10 to skip on the surface of the water, from which it bounces upwardly one or more times depending on it's speed and angle. Recesses 28–29 are made large enough for grasping flying saucer 10 but due to the small size of recesses 28–29 and the rotation of flying saucer 10 in flight recesses 28–29 have only a small effect upon the skipping ability of flying saucer 10. Insert 20 illustrated in FIG. 2 is a very economical product suitable for manufacture from a standard styrofoam slab having a thickness approximately equal to the height of interior side 18 of rim 13 and may be used in a wide variety of disks 12 regardless of their particular cross-section without regard for the size of the space 30 between insert 20 and interior surface 17 of disk 12.

Figure 3:
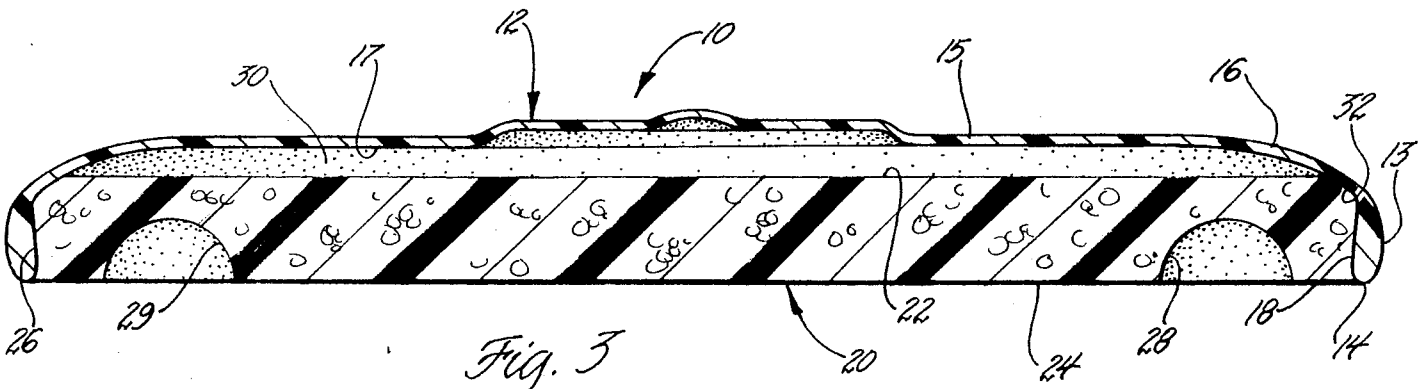
FIG. 3 is a cross section view of a flying saucer embodying the principals of the subject invention having an insert with parallel top and bottom surfaces and a tapered top surface for supporting the top of the disk.

In the embodiment illustrated in FIG. 3 the thickness of insert 20 is larger than shown in FIG. 2. Since the distance between upper surface 22 and lower surface 24 is greater, insert 20 in FIG. 3 is stronger and less likely to split, crack or break upon impact with a water surface. As shown in FIG. 3, a tapered section 32 is provided in upper surface 22 proximate a part of interior surface 17, which further supports interior surface 17, which adds rigidity to disk 12. Section 32 tapers downwardly and radially around the periphery of insert 20.

Figure 4:
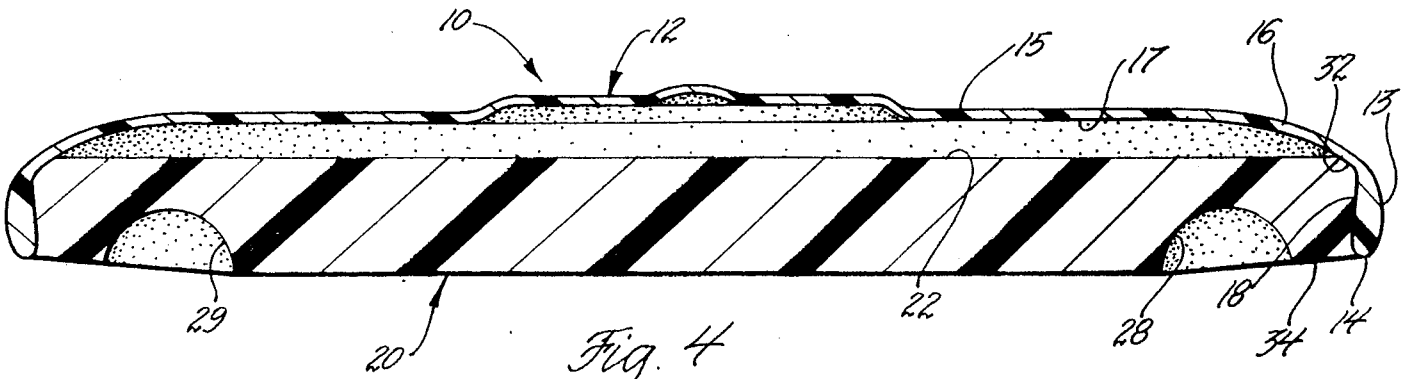
FIG. 4 is a cross-section view of a flying saucer embodying the principals of the subject invention and includes an insert having parallel top and bottom surfaces with a bottom surface tapered radially and upwardly outward.

In FIG. 4 the tapered section 32 in upper surface 22 of insert 20 is retained and a tapered section 34 is also provided extending radially outward and upward in lower surface 24 of insert 20. The tapered section 34 of lower surface 24 increases the ability of flying saucer 10 to skip on the surface of a fluid such as water.

Figure 5:
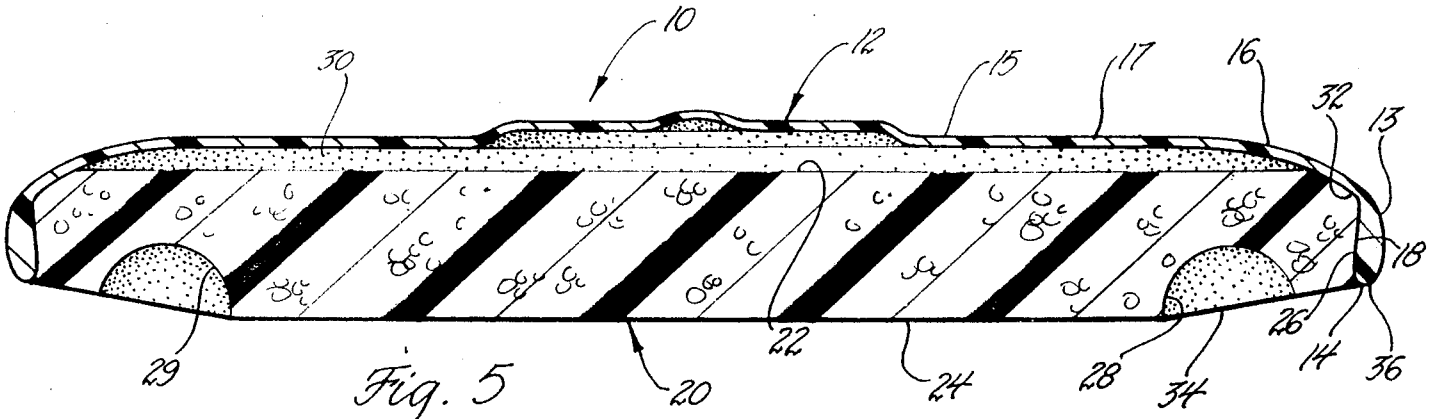
FIG. 5 is a cross-section view of a flying saucer embodying the principals of the subject invention and includes an insert having parallel top and bottom surfaces with tapered top and bottom surfaces and a contoured edge where the disk rim and insert join.

As shown in FIG. 5, a contour edge 36 is provided at the perimeter of lower surface 24 and the angle of tapered section 34 to the lower surface 24 is increased. In the embodiment in FIG. 5 when the flying saucer 10 is thrown at a fluid surface such as water the space between rim 13 and insert 20 is thus minimized so the flying saucer 10 presents a uniform surface which includes the rim 13, the contour edge 36, the tapered section 34 and lower surface 24 so as to increase the ability of flying saucer 10 to skip on the fluid surface.

Figure 6:
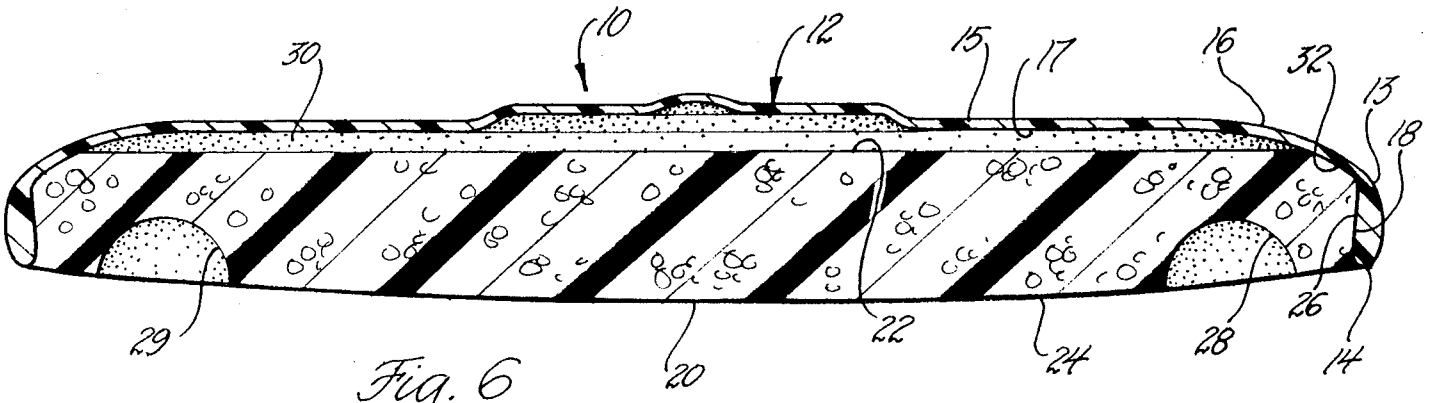
FIG. 6 is a cross-section view of a flying saucer embodying the principals of the subject invention and includes an insert having a convex bottom surface.

In the embodiment shown in FIG. 6 the lower surface 24 remains substantially parallel with upper surface 22 but lower surface 24 is provided with a convex configuration so as to present a smooth and continuous angular surface change, providing a smooth surface for flying saucer 10 to skip on a fluid.

Figure 7:
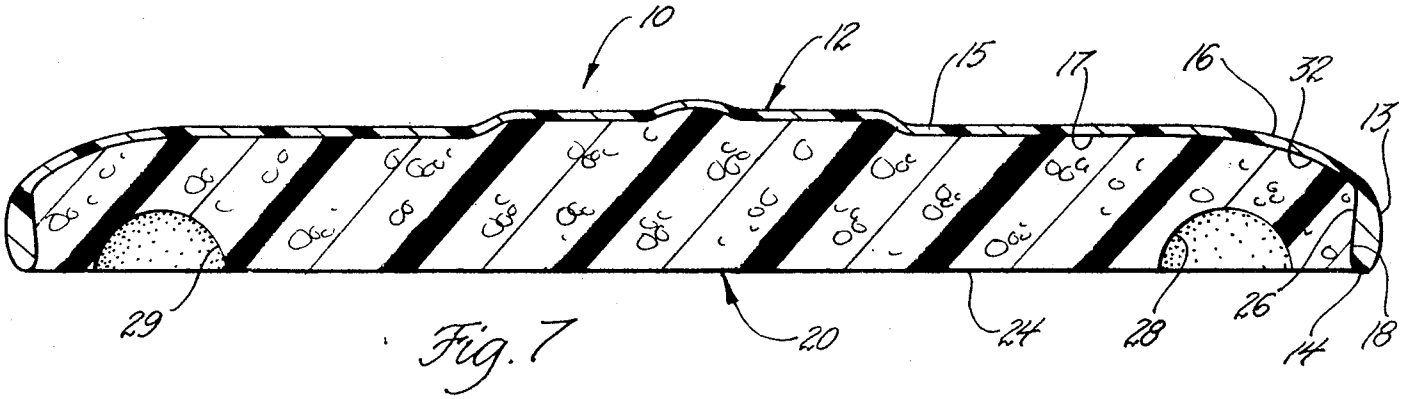
FIG. 7 is a cross-section view of a flying saucer embodying the principals of the subject invention having an insert which fills the disk interior surface and has a contoured edge.

In FIG. 7 insert 20 completely fills the inner surface 17 of disk 12, illustrating how insert 20 may be manufactured by being formed in the disk 12, such as by a suitable injection of styrofoam into the disk 12. Insert 20 may still be removable by coating interior surface 17 of disk 12 with a suitable release substance to prevent the foam of insert 20 sticking to the interior surface 17 of disk 12. By completely filling the disk 12, insert 20 provides a structural support for disk 12 so as to minimize likelihood of it cracking or being otherwise damaged if flying saucer 10 is thrown so as to impact other objects.

Figure 8:
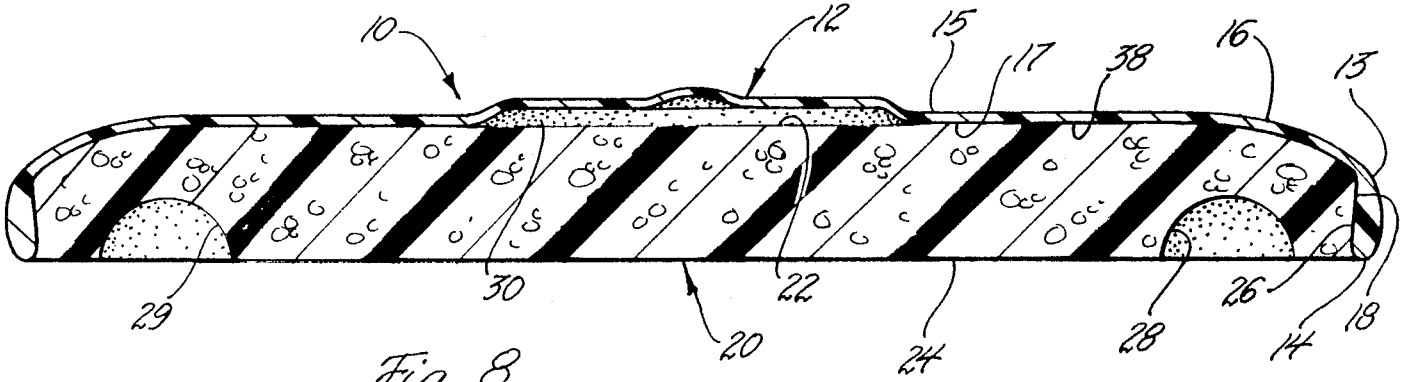
FIG. 8 is a cross-section view of a flying saucer embodying the principals of the subject invention having an insert secured to a disk by adhesive.

In FIG. 8 insert 20 is illustrated so as to have a large portion of upper surface 22 of insert 20 in direct contact with interior surface 17 of disk 12 and a thin coating of adhesive 38 is provided where interior surface 17 is in contact with upper surface 22, the adhesive being applied in an annular band on upper surface 22. Where disk 12 is provided with an inwardly and downwardly extending rim 13 as shown in the illustrated embodiments the adhesive 38 is not required but where rim 13 tapers straight downward or, as is the case in some flying saucers, rim 13 extends radially downwardly and outwardly so as to have a larger diameter at the bottom than at the top, the adhesive 38 assures securing the insert 20 in disk 12 during flight and while skipping on a fluid.

Figure 9:
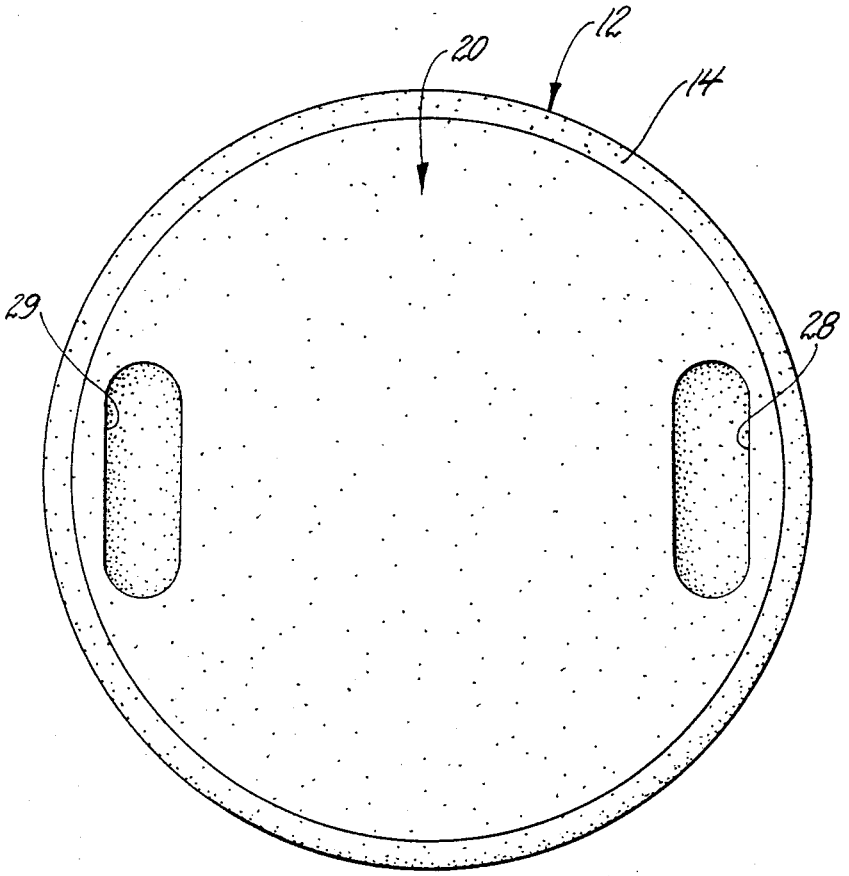
FIG. 9 is a perspective view of the FIG. 2 flying saucer taken along lines 9—9.

FIG. 9 is a perspective view of flying saucer 10 in FIG. 2 taken along lines 9—9 to illustrate the circular configuration of disk 12 in FIGS. 1–8 and the elongated configuration of the recesses 28–29. In a typical disk 12 measuring approximately 8.5 inches in diameter recesses 28–29 would be approximately three-fourths of an inch wide and approximately three-eighths of an inch deep as the over all height of disk 12 may be approximately one inch and thickness of insert 20 is approximately five-eighths of an inch, depending upon the selected embodiment.

As person versed in the art will appreciate, I have provided several embodiments of a flying saucer 10 comprised of a conventional flying saucer 10 disk 12 designed for flight and having a lightweight rigid insert 20 which does not significantly affect the flight characteristics of the disk 12 but which in combination with the insert 20 is capable of skipping when thrown on a fluid surface such as water or snow as the rim 13 of the disk 12 is less likely to catch in the fluid surface when the disk 12 is provided with the insert 20, depending on speed and angle.

I claim:

1. A flying saucer comprising, in combination, a disk, said disk including a substantially circular dome-shaped body and a downwardly extending rim substantially at the periphery of said body, said rim defining a downwardly extending edge, said body being defined by an exterior surface extending exteriorly of said edge and an interior surface extending interiorly of said edge, and a substantially circular insert positioned inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, said insert edge surface being positioned proximate said disk interior surface adjacent said downwardly extending rim whereby said rim presses against said insert edge surface so as to retain said insert in said disk, said insert disc skipping lower surface periphery being positioned proximate said disk edge so as to substantially cover the entire circular area bounded by said circular edge so as to form a disk skipping surface proximate said edge whereby when said disk is thrown so as to land on a fluid surface said insert disk skipping lower surface strikes said fluid, causing said disk and said insert to skip on said fluid surface.

2. A flying saucer comprising, in combination, a disk, said disk including a substantially circular dome-shaped body and a downwardly extending and inwardly tapering rim substantially at the periphery of said body, said rim defining a downwardly extending edge, said body being defined by an exterior surface extending exteriorly of said edge and an interior surface extending interiorly of said edge, and a substantially circular insert positioned inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, said insert edge surface being tapered downwardly and inwardly and positioned proximate said disk interior surface adjacent said downwardly extending and inwardly tapering rim whereby said rim presses against said insert edge surface so as to retain said insert in said disk, said insert disk skipping lower surface periphery being positioned proximate said disk edge so as to substantially cover the entire circular area bounded by said circular edge so as to form a disk skipping surface proximate said edge whereby when said disk is thrown so as to land on a fluid surface said insert disk skipping lower surface strikes said fluid, causing said disk and said insert to skip on said fluid surface.

3. A flying saucer comprising, in combination, a disk, said disk including a substantially circular dome-shaped body and a downwardly extending rim substantially at the periphery of said body, said rim defining a downwardly extending edge, said body being defined by an exterior surface extending exteriorly of said edge and an interior surface extending interiorly of said edge, and a substantially circular insert positioned inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, said insert edge surface being positioned proximate said disk interior surface adjacent said downwardly extending rim whereby said rim presses against said insert edge surface so as to retain said insert in said disk, said insert including at least one recess in said disk skipping lower surface to facilitate grasping said disk and said insert, said insert disk skipping lower surface periphery being positioned proximate said disk edge so as to substantially cover the area bounded by said edge so as to form a disk skipping surface proximate said edge whereby when said disk is thrown so as to land on a fluid surface said insert disk skipping lower surface strikes said fluid, causing said disk and said insert to skip on said fluid surface.

4. A flying saucer comprising, in combination, a disk, said disk including a substantially circular dome-shaped body and a downwardly extending rim substantially at the periphery of said body, said rim defining a downwardly extending edge, said body being defined by an exterior surface extending exteriorly of said edge and an interior surface extending interiorly of said edge, and a substantially circular insert positioned inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, said insert surface being tapered radially outward so as to substantially conform to at least part of said interior surface inwardly of said rim so as to at least partially be proximate said interior surface inwardly of said rim, said insert edge surface being positioned proximate said disk interior surface adjacent said downwardly extending rim whereby said rim presses against said insert edge surface so as to retain said insert in said disk, said insert disk skipping lower surface periphery being positioned proximate said disk edge so as to substantially cover the entire circular area bounded by said circular edge so as to form a disk skipping surface proximate said edge whereby when said disk is thrown so as to land on a fluid surface said insert disk skipping lower surface strikes said fluid, causing said disk and said insert to skip on said fluid surface.

5. A flying saucer comprising, in combination, a disk, said disk including a substantially circular dome-shaped body and a downwardly extending rim substantially at the periphery of said body, said rim defining a downwardly extending edge, said body being defined by an exterior surface extending exteriorly of said edge and an interior surface extending interiorly of said edge, and a substantially circular insert positioned inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, said disk skipping lower surface being substantially flat and positioned substantially proximate said rim edge, said insert edge surface being positioned proximate said disk interior surface adjacent said downwardly extending rim whereby said rim presses against said insert edge surface so as to retain said insert in said disk, said insert disk skipping lower surface periphery being positioned proximate said disk edge so as to substantially cover the entire circular area bounded by said circular edge so as to form a disk skipping surface proximate said edge whereby when said disk is thrown so as to land on a fluid surface said insert disk skipping lower surface strikes said fluid, causing said disk and said insert to skip on said fluid surface.

6. A flying saucer comprising, in combination, a disk, said disk including a substantially circular dome-shaped body and a downwardly extending rim substantially at the periphery of said body, said rim defining a downwardly extending edge, said body being defined by an exterior surface extending exteriorly of said edge and an interior surface extending interiorly of said edge, and a substantially circular insert positioned inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, at least part of said disk skipping lower surface being tapered radially outwardly and upwardly and having a center lower than said rim edge, said insert edge surface being positioned proximate said disk interior surface adjacent said downwardly extending rim whereby said rim presses against said insert edge surface so as to retain said insert in said disk, said insert disk skipping lower surface periphery being positioned proximate said disk edge so as to substantially cover the entire circular area bounded by said circular edge so as to form a disk skipping surface proximate said edge whereby when said disk is thrown so as to land on a fluid surface said insert disk skipping lower surface strikes said fluid, causing said disk and said insert to skip on said fluid surface.

7. A flying saucer comprising, in combination, a disk, said disk including a substantially circular dome-shaped body and a downwardly extending rim substantially at the periphery of said body, said rim defining a downwardly extending edge, said body being defined by an exterior surface extending exteriorly of said edge and an interior surface extending interiorly of said edge, and a substantially circular insert positioned inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, said disk skipping lower surface being convex and proximate said rim edge and having a center that is lower than said rim edge, said insert edge surface being positioned proximate said disk interior surface adjacent said downwardly extending rim whereby said rim presses against said insert edge surface so as to retain said insert in said disk, said insert disk skipping lower surface periphery being positioned proximate said disk edge so as to substantially cover the entire circular area bounded by said circular edge so as to form a disk skipping surface proximate said edge whereby when said disk is thrown so as to land on a fluid surface said insert disk skipping lower surface strikes said fluid, causing said disk and said insert to skip on said fluid surface.

8. A flying saucer comprising, in combination, a disk, said disk including a substantially circular dome-shaped body and a downwardly extending rim substantially at the periphery of said body, said rim defining a downwardly extending edge, said body being defined by an exterior surface extending exteriorly of said edge and an interior surface extending interiorly of said edge, and a substantially circular insert positioned inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, said insert disk skipping lower surface extending radially outward so as to abut substantially the lowest part of said rim edge, said insert edge surface being positioned proximate said disk interior surface adjacent said downwardly extending rim whereby said rim presses against said insert edge surface so as to retain said insert in said disk, said insert disk skipping lower surface periphery being positioned proximate said disk edge so as to substantially cover the entire circular area bounded by said circular edge so as to form a disk skipping surface proximate said edge whereby when said disk is thrown so as to land on a fluid surface said insert disk skipping lower surface strikes said fluid, causing said disk and said insert to skip on said fluid surface.

9. A flying saucer comprising, in combination, a disk, said disk including a substantially circular dome-shaped body and a downwardly extending rim substantially at the periphery of said body, said rim defining a downwardly extending edge, said body being defined by an exterior surface extending exteriorly of said edge and an interior surface extending interiorly of said edge, and a substantially circular insert positioned inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, said insert upper surface substantially conforming to and abutting said disk interior surface, said insert edge surface being positioned proximate said disk interior surface adjacent said downwardly extending rim whereby said rim presses against said insert edge surface so as to retain said insert in said disk, said insert disk skipping lower surface periphery being positioned proximate said disk edge so as to substantially cover the entire circular area bounded by said circular edge so as to form a disk skipping surface proximate said edge whereby when said disk is thrown so as to land on a fluid surface said insert disk skipping lower surface strikes said fluid, causing said disk and said insert to skip on said fluid surface.

10. A flying saucer comprising, in combination, a disk, said disk including a substantially circular dome-shaped body and a downwardly extending rim substantially at the periphery of said body, said rim defining a downwardly extending edge, said body being defined by an exterior surface extending exteriorly of said edge and an interior surface extending interiorly of said edge, and a substantially circular insert positioned inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, said insert edge surface being positioned proximate said disk interior surface adjacent said downwardly extending rim whereby said rim presses against said insert edge surface so as to retain said insert in said disk, said insert disk skipping lower surface periphery being positioned proximate said disk edge so as to substantially cover the entire circular area bounded by said circular edge so as to form a disk skipping surface proximate said edge whereby when said disk is thrown so as to land on a fluid surface said insert disk skipping lower surface strikes said fluid, causing said disk and said insert to skip on said fluid surface, and attachment means between said insert and said disk interior surface to facilitate retaining said insert in said disk.

11. A flying saucer comprising, in combination, a disk, said disk including a substantially circular dome-shaped body and a downwardly extending and inwardly tapering rim substantially at the periphery of said body, said rim defining a downwardly extending edge, said body being defined by an exterior surface extending exteriorly of said edge and an interior surface extending interiorly of said edge, and a substantially circular insert positioned inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, said insert edge surface being tapered inwardly and downwardly and positioned proximate said disk interior surface adjacent said downwardly extending and inwardly tapering rim whereby said rim presses against said insert edge surface so as to retain said insert in said disk, said insert including at least one recess in said disk skipping lower surface to facilitate grasping said disk and insert, said insert disk skipping lower surface periphery being positioned proximate said disk edge so as to substantially cover the area bounded by said edge so as to form a disk skipping surface proximate said edge whereby when said disk is thrown so as to land on a fluid surface said insert disk skipping lower surface strikes said fluid, causing said disk and said insert to skip on said fluid surface.

12. A flying saucer insert for use in combination with a flying saucer disk having a substantially circular dome-shaped body and a downwardly extending rim substantially at the periphery of said body, said rim defining a downwardly extending edge, said body being defined by an exterior surface extending exteriorly of said edge and an interior surface extending interiorly of said edge, said insert being substantially circular and positionable inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, said insert edge surface being positioned proximate said disk interior surface adjacent said downwardly extending rim whereby said rim presses against said insert edge surface so as to retain said insert in said disk, said insert disk skipping lower surface periphery being positioned proximate said disk edge so as to substantially cover the entire circular area bounded by said circular edge so as to form a disk skipping surface proximate said edge whereby when said disk is thrown so as to land on a fluid surface said insert disk skipping lower surface strikes said fluid, causing said disk and said insert to skip on said fluid surface.

13. A flying saucer insert for use in combination with a flying saucer disk having a substantially circular dome-shaped body and a downwardly extending rim substantially at the periphery of said body, said rim defining a downwardly extending edge, said body being defined by an exterior surface extending exteriorly of said edge and an interior surface extending interiorly of said edge, said insert being substantially circular and positionable inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, at least part of said disk skipping lower surface being tapered radially outwardly and upwardly and having a center lower than said rim edge, said insert edge surface being positioned proximate said disk interior surface adjacent said downwardly extending rim whereby said rim presses against said insert edge surface so as to retain said insert in said disk, said insert disk skipping lower surface periphery being positioned proximate said disk edge so as to substantially cover the entire circular area bounded by said circular edge so as to form a disk skipping surface proximate said edge whereby when said disk is thrown so as to land on a fluid surface said insert disk skipping lower surface strikes said fluid, causing said disk and said insert to skip on said fluid surface.

14. A flying saucer insert for use in combination with a flying saucer disk having a substantially circular dome-shaped body and a downwardly extending rim substantially at the periphery of said body, said rim defining a downwardly extending edge, said body being defined by an exterior surface extending exteriorly of said edge and an interior surface extending interiorly of said edge, said insert being substantially circular and positionable inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, said lower surface being convex and proximate said rim edge and having a center that is lower than said rim edge, said insert edge surface being positioned proximate said disk interior surface adjacent said downwardly extending rim whereby said rim presses against said insert edge surface so as to retain said insert in said disk, said insert disk skipping lower surface periphery being positioned proximate said disk edge so as to substantially cover the area bounded by said edge so as to form a disk skipping surface proximate said edge whereby when said disk is thrown so as to land on a fluid surface said insert disk skipping lower surface strikes said fluid, causing said disk and said insert to skip on said fluid surface.

15. A flying saucer insert for use in combination with a flying saucer disk having a substantially circular dome-shaped body and a downwardly extending rim substantially at the periphery of said body, said rim defining a downwardly extending edge, said body being defined by an exterior surface extending exteriorly of said edge and an interior surface extending interiorly of said edge, said insert being substantially circular and positionable inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, said insert disk skipping lower surface extending radially outward so as to abut substantially the lowest part of said rim edge, said insert edge surface being positioned proximate said disk interior surface adjacent said downwardly extending rim whereby said rim presses against said insert edge surface so as to retain said insert in said disk, said insert disk skipping lower surface periphery being positioned proximate said disk edge so as to substantially cover the entire circular area bounded by said circular edge so as to form a disk skipping surface proximate said edge whereby when said disk is thrown so as to land on a fluid surface said insert disk skipping lower surface strikes said fluid, causing said disk and said insert to skip on said fluid surface.

16. A flying saucer insert for use in combination with a flying saucer disk having a substantially circular dome-shaped body and a downwardly extending rim substantially at the periphery of said body, said rim defining a downwardly extending edge, said body being defined by an exterior surface extending exteriorly of said edge and an interior surface extending interiorly of said edge, said insert being substantially circular and positionable inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, said insert upper surface substantially conforming to and abutting said disk interior surface, said insert edge surface being positioned proximate said disk interior surface adjacent said downwardly extending rim whereby said rim presses against said insert edge surface so as to retain said insert in said disk, said insert disk skipping lower surface periphery being positioned proximate said disk edge so as to substantially cover the entire circular area bounded by said circular edge so as to form a disk skipping surface proximate said edge whereby when said disk is thrown so as to land on a fluid surface said insert disk skipping lower surface strikes said fluid, causing said disk and said insert to skip on said fluid surface.

17. A flying saucer insert for use in combination with a flying saucer disk having a substantially circular dome-shaped body and a downwardly extending rim substantially at the periphery of said body, said rim defining a downwardly extending edge, said body being defined by an exterior surface extending exteriorly of said edge and an interior surface extending interiorly of said edge, said insert being substantially circular and positionable inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, said insert edge surface being positioned proximate said disk interior surface adjacent said downwardly extending rim whereby said rim presses against said insert edge surface so as to retain said insert in said disk, said insert disk skipping lower surface periphery being positioned proximate said disk edge so as to substantially cover the entire circular area bounded by said circular edge so as to form a disk skipping surface proximate said edge whereby when said disk is thrown so as to land on a fluid surface said insert disk skipping lower surface strikes said fluid, causing said disk and said insert to skip on said fluid surface, and attachment means between said interior surface to facilitate attaching said insert to said disk.

18. A flying saucer insert for use in combination with a flying saucer disk having a substantially circular dome-shaped body and a downwardly extending rim substantially at the periphery of said body, said rim defining a downwardly extending edge, said body being defined by an exterior surface extending exteriorly of said edge and an interior surface extending interiorly of said edge, said insert being substantially circular and positionable inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, said lower surface being substantially flat and positioned substantially proximate said rim edge, said insert edge surface being positioned proximate said disk interior surface adjacent said downwardly extending rim whereby said rim presses against said insert edge surface so as to retain said insert in said disk, said insert including at least one recess in said lower surface to facilitate grasping said disk and insert, said insert disk skipping lower surface periphery being positioned proximate said disk edge so as to substantially cover the area bounded by said edge so as to form a disk skipping surface proximate said edge whereby when said disk is thrown so as to land on a fluid surface said insert disk skipping lower surface strikes said fluid, causing said disk and said insert to skip on said fluid surface.

19. A flying saucer insert for use in combination with a flying saucer disk having a substantially circular dome-shaped body and a downwardly extending rim substantially at the periphery of said body, said rim defining a downwardly extending edge, said body being defined by an exterior surface extending exteriorly of said edge and an interior surface extending interiorly of said edge, said insert being substantially circular and positionable inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, at least part of said lower surface being tapered radially outwardly and upwardly and having a center lower than said rim edge, said insert edge surface being positioned proximate said disk interior surface adjacent said downwardly extending rim whereby said rim presses against said insert edge surface so as to retain said insert in said disk, said insert including at least one recess in said lower surface to facilitate grasping said disk and insert, said insert disk skipping lower surface periphery being positioned proximate said disk edge so as to substantially cover the area bounded by said edge so as to form a disk skipping surface proximate said edge whereby when said disk is thrown so as to land on a fluid surface said insert disk skipping lower surface strikes said fluid, causing said disk and said insert to skip on said fluid surface.

20. A flying saucer insert for use in combination with a flying saucer disk having a substantially circular dome-shaped body and a downwardly extending rim substantially at the periphery of said body, said rim defining a downwardly extending edge, said body being defined by an exterior surface extending exteriorly of said edge and an interior surface extending interiorly of said edge, said insert being substantially circular and positionable inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, said lower surface being convex and proximate said rim edge and having a center that is lower than said rim edge, said insert edge surface being positioned proximate said disk interior surface adjacent said downwardly extending rim whereby said rim presses against said insert edge surface so as to retain said insert in said disk, said insert including at least one recess in said disk skipping lower surface to facilitate grasping said disk and insert, said insert disk skipping lower surface periphery being positioned proximate said disk edge so as to substantially cover the area bounded by said edge so as to form a disk skipping surface proximate said edge whereby when said disk is thrown so as to land on a fluid surface said insert disk skipping lower surface strikes said fluid, causing said disk and said insert to skip on said fluid surface.

21. A flying saucer insert for use in combination with a flying saucer disk having a substantially circular dome-shaped body and a downwardly extending rim substantially at the periphery of said body, said rim defining a downwardly extending edge, said body being defined by an exterior surface extending exteriorly of said edge and an interior surface extending interiorly of said edge, said insert being substantially circular and positionable inside said rim proximate said interior surface, said insert having an upper surface proximate said interior surface, a disk skipping lower surface opposite said upper surface and an edge surface connecting the peripheries of said upper and lower surfaces, said insert being made of a light weight substantially rigid material, said insert disk skipping lower surface extending radially outward so as to abut substantially the lowest part of said rim edge, said insert edge surface being positioned proximate said disk interior surface adjacent said downwardly extending rim whereby said rim presses against said insert edge surface so as to retain said insert in said disk, said insert including at least one recess in said disk skipping lower surface to facilitate grasping said disk and insert, said insert disk skipping lower surface periphery being positioned proximate said disk edge so as to substantially cover the area bounded by said edge so as to form a disk skipping surface proximate said edge whereby when said disk is thrown so as to land on a fluid surface said insert disk skipping lower surface strikes said fluid, causing said disk and said insert to skip on said fluid surface.

* * * * *